US005785414A

United States Patent [19]

Baker et al.

[11] Patent Number: 5,785,414

[45] Date of Patent: Jul. 28, 1998

[54] LIGHTING SYSTEM

[75] Inventors: Paul William Baker, Congleton; Bernard Lawrence Phillip Ackers, Middlewich, both of United Kingdom

[73] Assignee: Gradus Limited, Chesire, England

[21] Appl. No.: 664,937

[22] Filed: Jun. 14, 1996

[30] Foreign Application Priority Data

Jun. 15, 1995 [GB] United Kingdom ..... 9512205

[51] Int. Cl.[6] ..... F21V 3/00

[52] U.S. Cl. ..... 362/240; 362/255; 362/800

[58] Field of Search ..... 362/240, 248, 362/249, 255, 311, 363, 800, 267

[56] References Cited

U.S. PATENT DOCUMENTS

| | | | |
|---|---|---|---|
| 4,924,362 | 5/1990 | Janko et al. | 362/108 |
| 5,567,037 | 10/1996 | Ferber | 362/104 |
| 5,593,223 | 1/1997 | Koizumi | 362/255 |

*Primary Examiner*—Stephen F. Husar
*Attorney, Agent, or Firm*—Salter & Michaelson

[57] ABSTRACT

A lighting system which comprises a housing (10) contains a light emitting diode (34) that fits into a lens (30). The lens is secured to the housing (10) so that the position of the lens relative to the housing is also fixed. One or more housings are fitted into a channel (50) closed by a transparent or translucent cover (52).

8 Claims, 2 Drawing Sheets

LIGHTING SYSTEM

This invention relates to lighting and more particularly lighting that is intended for emergencies.

In certain locations such as hospitals, ships and airplanes it is now required that emergency lighting be provided at floor level so as to provide guidance to emergency exits. Normally the lighting is required to extend along a path which may be straight, but may in many cases turn one or more corners. Lighting systems for this purpose must be able to operate in adverse conditions. Thus they should be flame retardant, they must be waterproof and they must emit sufficient light that they can be seen even when the surrounding atmosphere is smoke filled.

One system that has been designed with the intention of meeting these requirements comprises a strip having light emitting diodes (LEDS) at intervals therealong and enclosed in a a translucent tube. The tube is closed at each end with a connector by which the LEDS in the tube can be electrically connected to the LEDS in another, adjacent tube or to a power supply. The tubes are installed at ground level with the upper surface of the tube being exposed. There are considerable problems with this system. First the tubes must be made to fit the particular location where they are to be installed. This may mean making tubes to different lengths for different situations. Secondly if a tube is damaged, something that is likely to happen at the exposed upper surface, then that tube must be replaced. Similarly if a fault develops within the tube, the whole tube must be replaced. The interconnection of a series of tubes makes it very difficult to remove a tube except at the ends of the series. Thirdly the interconnections themselves, although provided with seals are not reliably waterproof. Ingress of water into a tube will very likely cause a short circuit and prevent operation of the LEDS if an emergency should occur.

The present invention seeks to deal with these problems

According to the invention there is provided a lighting system comprising a housing, illuminable means located in the housing and electrical connections to the illuminable means characterised in that a transparent or translucent cap holds the illuminable means in a fixed disposition relative to the housing, said electrical connections being encapsulated.

In a preferred embodiment of the invention a plurality of housings having illuminable means are connected together by flexible electric cables so as to provide a flexible array of spaced apart lighting points. Preferably the housings are profiled so as to be receivable in a channel, for example of extruded plastic. The profile of the housing and of the channel is designed so that the housing can only be fitted into the channel in one orientation. A transparent or translucent cover is preferably provided for closing the top of the channel. If desired the cover can be adapted when secured to the channel, to extend over the adjacent edge of floor covering on one or both sides of the channel.

A specific embodiment of the invention will now be described by way of example with reference to the accompanying drawings in which.

Figure 1:
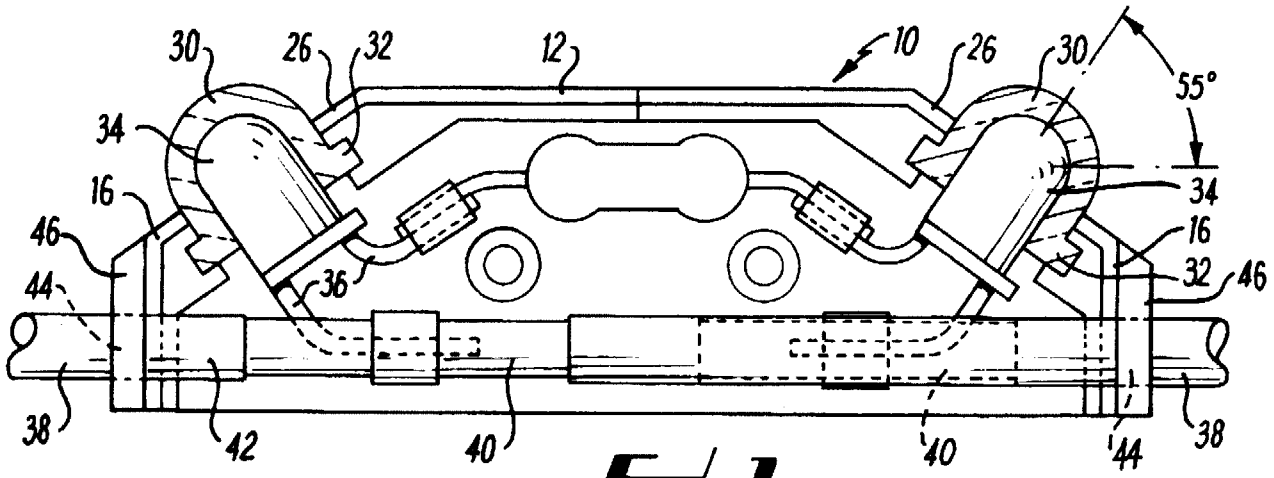
FIG. 1 is a longitudinal section through a housing.
Figure 2:
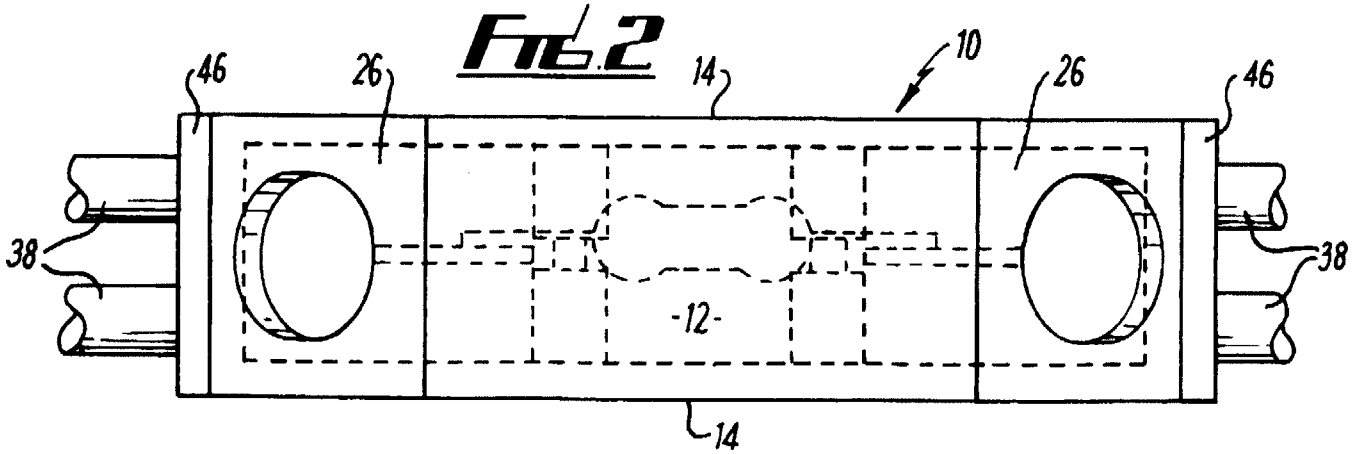
FIG. 2 is a plan view of the housing.
Figure 3:
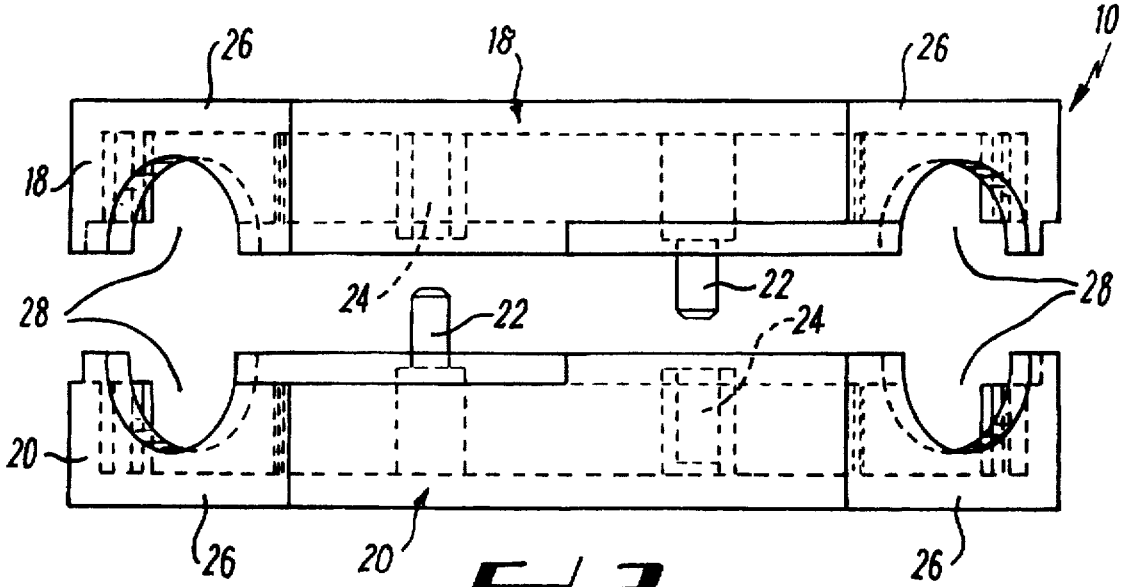
FIG. 3 is a plan view of the parts of the housing.

Referring to FIGS. 1 and 2 of the drawings a housing 10 having a top 12, sides 14 and ends 16 and an open bottom 16 is formed from two like parts 18, 20 (see FIG. 3). The hosing parts are preferably moulded from plastics material which is flame retardant, such as polycarabonate. The two parts are held together by a plug 22 projecting from the inner surface of the side wall of each part received in a socket 24 on the opposite side of the inner surface of the side wall of each part.

Between the top 12 and end walls 16 there is a chamfered portion 26. A semicircular cut out 28 is formed in the chamfered portion of each part 18 and 20 so that when the parts 18 and 20 are brought together the cut outs 28 form a substantially circular aperture. Lenses 30 are located in these apertures formed by cut outs 28. The lenses are made of polycarbonate or other flame retardant material and are generally hemispherical, hollow bodies having out-turned flanges 32 by which they are locked in position in the apertures when the parts 18 and 20 are brought together. Internally the lenses are sized to receive an LED 34. It will be appreciated that with this kind of assembly the LED can be disposed at any desired orientation. In the embodiment illustrated in the drawings the LEDS 34 are held by the lenses 30 at a particular angle, 55° to the horizontal. Further the lenses concentrate the light from the LEDS so that the illumination therefrom will penetrate a smoke filled environment.

As can be seen in FIG. 1 the LEDS are connected by loads 36 to the conductor of a cable 38, at sites 40 where the cable insulation 42 has been stripped off. The cables 38 extend from either end of the housing through apertures 44 in end closures 46.

Once the LEDS have been connected to the cables 38 the housing is filled with a suitable resin, for example a polycarbonate or an epoxy resin containing a flame retardant additive. The provision of the LEDS in the lenses ensures that the LEDS are maintained in their desired position during this forming process. In the resulting product the connections to the LEDS are encapsulate din the material formed in the housing and, therefore, completely waterproof. A loom of such units can be connected together at intervals, for example of 200 mm over any desired length. Usually a length of 30 meters is convenient.

Figure 4:
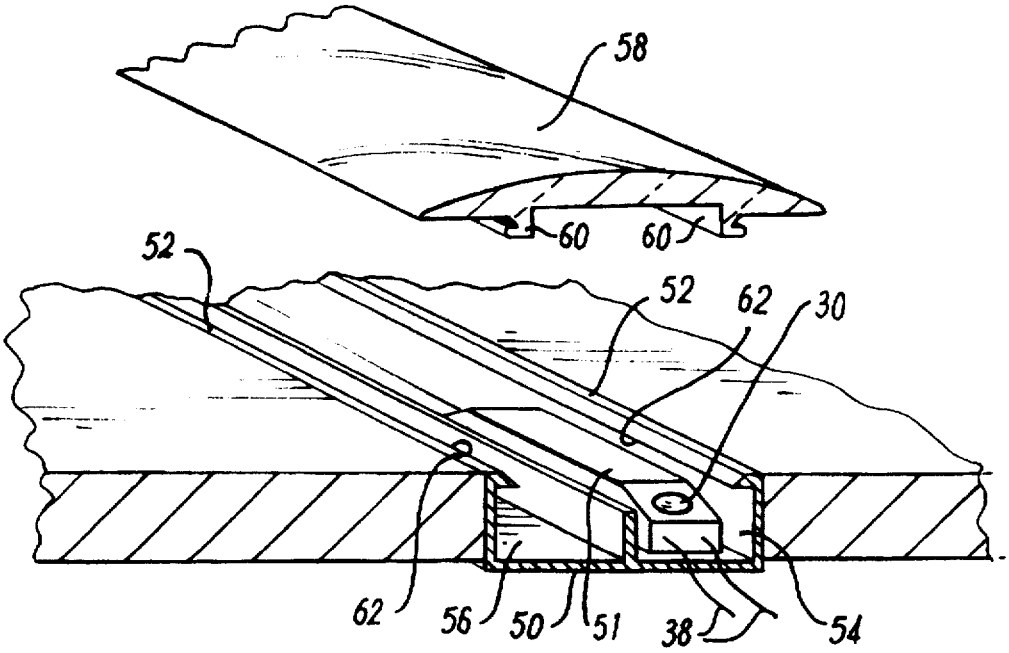
FIG. 4 is a perspective view, partly in section of a series of interconnected housings installed in a channel in a floor.

The installation of such a loom will now be described with reference to FIG. 4. An extruded twin channel member 50 is installed in a floor so that the rims 52 of the member 50 are at floor level. A loom comprising a plurality of lighting units 52 is described in connection with FIGS. 1 to 3 connected at intervals by cables 38 is located in one of the channels 54 of member 50. The cross section of channel 54 is matched to the cross section of housing 10 of the lighting units 52 so that the units can only be received in the channel 54 in the correct orientation, that is to say with lenses 30 directed upwardly. The other channel 56 in member 50 is available for control circuitry (not shown) for the loom if that is required.

The channel 50 can be closed by a transparent or translucent cover 58. The underside of the cover 50 has flanged ribs 60 which engage with inturned flanges 62 on the rims of the member 50. In the embodiment shown in the drawing the cover 58 is wider than the channel member 50. The edges of the cover can act to retain floor covering, such as a carpet on either side of the member 50.

The invention is not limited to the above described embodiments and many variations and modifications can be made. For example the channel member 50 can have just one channel or can have more than two channels. The cover does not need to be wider than the channel member. The lens can, if desired, be replaced by a prime or other appropriate optical device.

We claim:

1. A lighting system comprising at least on housing, illumination means located in the housing, and electrical connections to the illumination means, wherein the improvement comprises a transparent or translucent cap holding the illumination means in a fixed disposition relative to the housing, and said electrical connections being encapsulated by said housing.

2. A lighting system as claimed in claim 1 further comprising a channel, said housing being received within the channel.

3. A lighting system as claimed in claim 2, said channel being profiled so as to receive the housing in a predetermined orientation.

4. A lighting system as claimed in claim 2, said channel being provided with a transparent or translucent cap.

5. A lighting system as claimed in claim 1, said cap being sized to receive said illumination means.

6. A lighting system as claimed in claim 1, said cap being received in an aperture in the housing.

7. A lighting system as claimed in claim 1 further comprising additional illumination means.

8. A lighting system comprising a plurality of housings, illumination means located in each said housing, and electrical connections to each said illumination means, said illuminating means located in the housings being connected together by flexible connections, wherein the improvement comprises respective transparent or translucent caps for holding each said illumination means in a fixed disposition to each said housing, said electrical connections being encapsulated by said housing.

* * * * *